United States Patent [19]

Stedman

[11] 4,044,480

[45] Aug. 30, 1977

[54] ELEVATING SCRAPER WITH PERFORATE SEPARATOR

[75] Inventor: Robert Norris Stedman, Chillicothe, Ill.

[73] Assignee: Caterpillar Tractor Co., Peoria, Ill.

[21] Appl. No.: 690,347

[22] Filed: May 27, 1976

[51] Int. Cl.[2] ..... E02F 1/00; B07B 1/00

[52] U.S. Cl. ..... 37/8; 209/241; 198/836; 171/10; 171/15

[58] Field of Search ..... 37/8; 171/10, 14–16, 171/71, 73; 198/203, 836; 209/241, 381, 421; 172/32

[56] References Cited

U.S. PATENT DOCUMENTS

| | | | |
|---|---|---|---|
| 1,251,425 | 12/1917 | Rogers et al. | 171/14 |
| 2,368,331 | 1/1945 | Seaman | 172/32 |
| 2,528,689 | 11/1950 | Flynt | 171/10 |
| 3,296,715 | 1/1967 | Jass et al. | 37/8 |
| 3,356,157 | 12/1967 | Plasser et al. | 171/16 |
| 3,474,547 | 10/1969 | Campbell et al. | 37/8 |
| 3,701,422 | 10/1972 | Downey | 209/241 |
| 3,805,895 | 4/1974 | Teigen | 171/15 |
| 3,959,896 | 6/1976 | Wagner | 37/8 |

FOREIGN PATENT DOCUMENTS

| | | | |
|---|---|---|---|
| 232,825 | 3/1960 | Australia | 171/14 |

*Primary Examiner*—E. H. Eickholt

*Attorney, Agent, or Firm*—Wegner, Stellman, McCord, Wiles & Wood

[57] ABSTRACT

An elevating scraper adapted to be towed by a tractor to perform earth-grading operations and the like including a vehicle frame, towing means on the frame, and a forwardly open scraper bowl located on the frame and terminating in a lower, forwardly extending scraper edge. An upwardly and rearwardly extending elevating conveyor assembly is mounted on the frame forwardly of the scraper bowl and spaced from the scraper edge, and a support surface is situated closely adjacent the conveyor assembly and cooperates therewith so that material may be elevated by the conveyor assembly and supported during such elevation by the support surface and moved into the scraper bowl. The support surface is perforate so that material of large size will be directed to the scraper bowl while smaller sized material will pass through the support surface to the underlying terrain.

5 Claims, 2 Drawing Figures

ELEVATING SCRAPER WITH PERFORATE SEPARATOR

BACKGROUND OF THE INVENTION

This invention relates to earth scraper assemblies and, more specifically, to elevating scrapers used in earth grading operations and the like where it is desired to selectively remove relatively large earth material and/or debris from the terrain to be graded.

Previous methods of removing rocks and/or debris involved the use of ripper-type rock blades on bulldozers or conveyor systems used in conjuctions with a composite bulldozer blade and grating. The latter method normally involved the use of a separate receptacle, such as a truck, for the removed material.

Ripper-type blades on bulldozers have the disadvantages of being unable to continuously disengage the larger material from the terrain and efficiently convey such material to a suitable receptacle for later disposition.

Bulldozer blades used with attached gratings and leading to conveyor systems have had disadvantage of requiring a separate receptacle, such as a dump truck, to receive and dispose of the material removed from the terrain. Also, these blade grating systems do not remove the larger material, but segregate it for later removal.

SUMMARY OF THE INVENTION

It is an object of the invention to provide a new and improved elevating scraper assembly for use in earthgrading operations and the like. More specifically, it is an object of the invention to provide an elevating scraper assembly wherein a conveyor assembly cooperates with a scraper edge and support surface to elevate material over a perforate support surface such that material of small size will pass through the support surface to the underlying terrain, while material of larger size will be directed to a scraper bowl located rearwardly of the conveyor assembly and support surface.

An exemplary embodiment of the invention includes a support surface comprising a grid assembly including a plurality of spaced parallel bars extending upwardly and rearwardly of the cutting edge of the support surface.

One preferred embodiment of the invention comprises the above grid assembly and a second surface extending downwardly and rearwardly of the first grid assembly toward the scraper edge of the scraper bowl. The second surface may be perforate or non-perforate.

In a highly preferred embodiment of the invention, the second surface will be linked to motor means at the rear of the scraper bowl so that the second surface may be moved between open and closed positions, thereby allowing the scraper bowl to be emptied.

Other objects and advantages will become apparent from the following specification taken in connection with the accompanying drawings.

DESCRIPTION OF THE PREFERRED EMBODIMENTS

Figure 1:
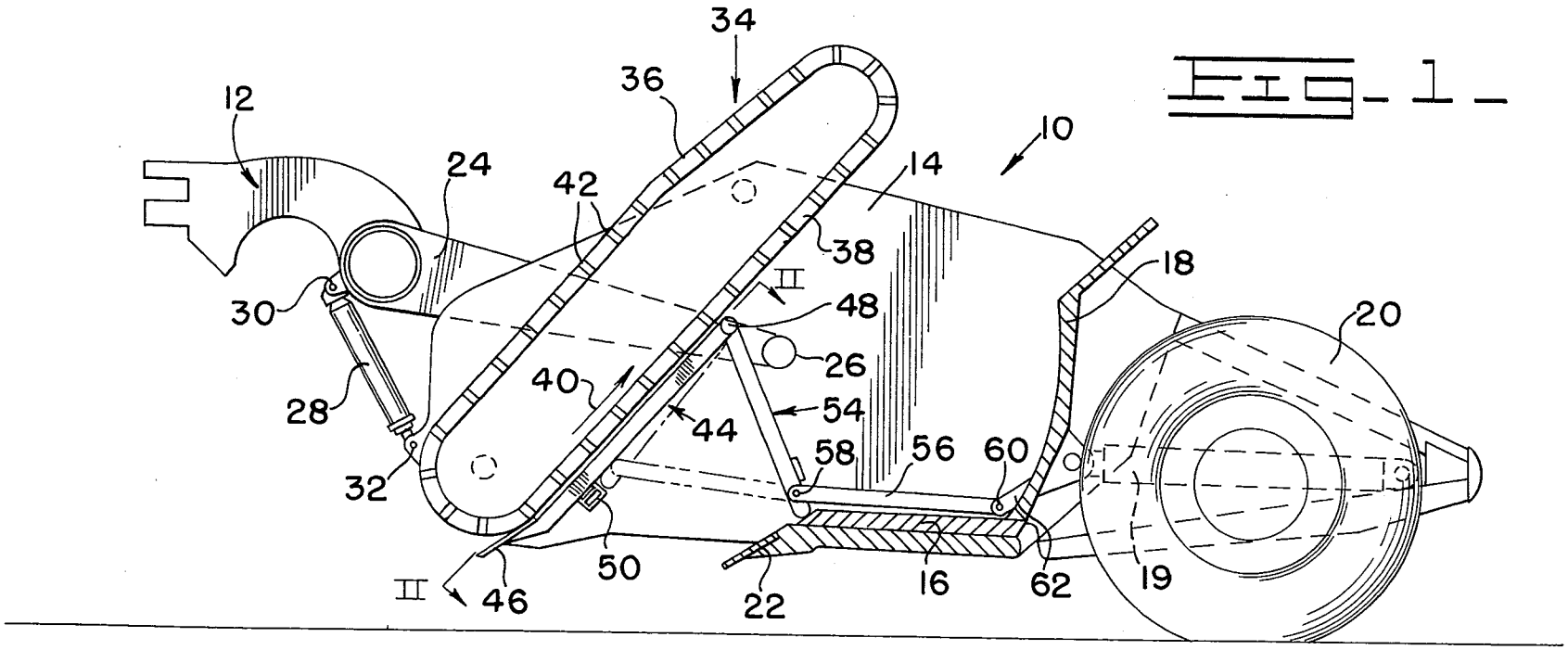
FIG. 1 is a side elevational view of an elevating scraper vehicle adapted to be towed by a tractor for use in earthgrading operations and the like with parts shown in section.

Referring to FIG. 1, an exemplary embodiment of the invention includes a vehicle frame, generally designated 10, provided with towing means in the form of a conventional hitch structure 12 to be connected to a tractor (not shown) or the like. The vehicle frame 10 includes spaced apart sidewalls 14 (only one of which is shown) which are interconnected at their lower extremity by a bottom wall 16. A movable rear wall 18 is disposed above the bottom wall 16 and between the sidewalls 14 and may be reciprocated by a hydraulic jack or motor 19 for purposes to be seen. Wheels 20 are mounted on the frame 10 in any conventional fashion.

The walls 14, 16 and 18 define a forwardly open scraper bowl for receipt of material scraped from the underlying terrain as the vehicle moves thereacross. For example, a conventional scraper blade 22 may be associated with the bottom wall 16 and brought into contact with the underlying terrain to lift material scraped therefrom into the scraper bowl. In this respect, the frame 10 includes a pair of spaced arms 24 extending rearwardly from the hitch 12 to be pivoted to the sidewalls 14 at 26. A hydraulic cylinder 28 is pivotally connected to the hitch 12 at 30 and to the sidewalls 14 at 32. When extended, the cylinder 28 will cause the scraper bowl to lower to bring the scraper blade 22 into contact with the underlying terrain.

The scraper also includes an elevating conveyor assembly, generally designated 34, of conventional construction. The elevator conveyor assembly is formed of spaced, continuous chains 36 (only one of which is shown), one adjacent each sidewall 14. The chains 36 are suitably trained about sprockets (not shown) to assume the position illustrated in FIG. 1 and a motor (not shown) is employed to drive such sprockets such that the lower run 38 of the chains moves upwardly and rearwardly in the direction of an arrow 40.

A series of spaced flights 42 interconnect the chains 36 and engage material to be moved into the bowl to lift the same along an underlying support surface, generally designated 44. The support surface 44 immediately underlies the lower portion of the lower run 38 of the chains 36 and includes a scraper blade 46 which, like the scraper blade 22, can be brought into contact with the underlying terrain by extension of the cylinder 28.

Figure 2:
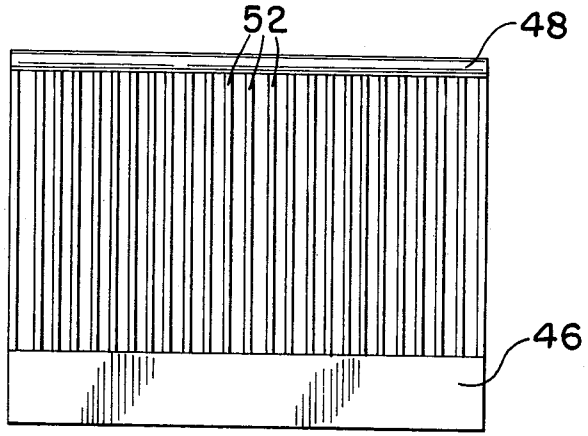
FIG. 2 is a sectional view of a support surface taken along line 2—2 of FIG. 1.

The support surface 44 is supported by upper and lower cross members 48 and 50, respectively, extending between the sidewalls 14. As seen in FIG. 2, the support surface 44 is perforate and is in the form of a grid defined by plural, parallel bars 52 which extend upwardly and rearwardly. Referring to FIG. 1, it will be seen that the support surface 44 is forwardly of the scraper edge 22. As a consequence of this construction, material being elevated by the elevating conveyor assembly 34 of a sufficiently small size to pass between the bars 52 will not be deposited in the scraper bowl but will pass between the bars 52 to return to the underlying terrain. Thus, in the case of rugged roads as, for example, logging rods wherein large rocks migrate to the surface of the road over a period of time, such a road may be graded employing the scraper of the present invention. Such rocks will be lifted into the scraper bowl while gravel or soil will return to the road through the bars 52.

By closely spacing the bars 52 or by employing a mesh-type screen in connection therewith, the scraper can be advantageously employed in the clearing of beaches or the like. Refuse such as partially burned logs, beverage cans, or the like, will be elevated into the scraper bowl while the sand will return to the underlying terrain.

In a highly preferred embodiment, a gate, generally designated 54, may be employed for selectively opening or closing the scraper bowl. The gate 54 is pivotally connected to the cross member 48 and extends downwardly and rearwardly therefrom toward the scraper edge 22. Spaced apart links 56 adjacent each of the sidewalls 14 are pivoted at 58 to the gate 54 and at 60 to ears 62 connected to the rear scrapper wall 18. Thus, extension of the cylinder 19 will cause the links 56 to pivot the gate 54 to the dotted line position of FIG. 1 while retraction of the cylinder 19 will cause the gate 54 to assume the solid line position of FIG. 1.

In a highly preferred embodiment, the gate 54 is also perforate so as to allow material of a small size elevated by the elevator conveyor 34 and not passing through the support surface 44 to return to the underlying terrain.

When the scraper bowl is to be emptied, it is only necessary to move the gate 54 to its open position and cause the movable rear wall 18 to move forwardly to eject the accumulated material in the bowl.

What is claimed is:

1. In an elevating scraper adapted to be towed by a tractor to perform earth-grading operations and the like including a vehicle frame, means on the frame whereby the frame may be towed over the underlying terrain, a forwardly open scraper bowl on said frame and terminating in a lower, forwardly extending scraper edge, an upwardly and rearwarding extending elevating conveyor assembly mounted on said frame forwardly of said scraper bowl and spaced from said scraper edge, and a support surface closely adjacent to and extending upwardly from the lower end of said conveyor assembly and cooperating therewith whereby material may be elevated by said conveyor assembly and supported during such elevation by said support surface to be moved into said scraper bowl, the improvement wherein said support surface comprises a first grid assembly; means securing said first grid assembly to said frame; a second grid assembly extending downwardly and rearwardly from said first grid assembly toward said scraper edge and means mounting said second grid assembly on said frame for movement between positions opening and closing said scraper bowl.

2. The elevating scraper of claim 1, wherein the second grid assembly comprises a plurality of spaced parallel bars extending downwardly and rearwardly from the first grid assembly.

3. In an elevating scraper adapted to be towed by a tractor to perform earth-grading operations and the like including a vehicle frame, means on the frame whereby the frame may be towed over the underlying terrain, a forwardly open scraper bowl on said frame and terminating in a lower, forwardly extending scraper edge, an upwardly and rearwardly extending elevating conveyor assembly mounted on said frame forwardly of said scraper bowl and spaced from said scraper edge, and a support surface closely adjacent to and extending upwardly from the lower end of said conveyor assembly and cooperating therewith whereby material may be elevated by said conveyor assembly and supported during such elevation by said support surface to be moved into said scraper bowl, the improvement wherein said support surface comprises a grid assembly; means securing said grid assembly to said frame; a gate extending downwardly and rearwardly from said grid assembly toward said scraper edge and means mounting said gate on said frame for movement between positions opening and closing said scraper bowl.

4. The elevating scraper of claim 3 wherein said gate is perforate.

5. The elevating scraper of claim 4 including motor means and linking means comprising two spaced linear links, one on each side of said bowl, one end of each link being connected to said second grid assembly and the opposite end of each link being connected to said motor means.

* * * * *